US005335427A

United States Patent [19]

Partio

[11] Patent Number: 5,335,427

[45] Date of Patent: Aug. 9, 1994

[54] DEVICE FOR REMOVING LIQUID FROM INSIDE A ROTATING CYLINDER OR ROLL

[76] Inventor: Martti E. O. Partio, Uudenmaankatu 36, Kouvola, Finland, SF-45130

[21] Appl. No.: 962,573

[22] PCT Filed: May 3, 1991

[86] PCT No.: PCT/FI91/00138

§ 371 Date: Jan. 25, 1993

§ 102(e) Date: Jan. 25, 1993

[87] PCT Pub. No.: WO91/19853

PCT Pub. Date: Dec. 26, 1991

[30] Foreign Application Priority Data

Jun. 19, 1990 [FI] Finland ..... 903073

[51] Int. Cl.[5] ..... F26B 13/18

[52] U.S. Cl. ..... 34/119; 34/125; 34/124; 165/89

[58] Field of Search ..... 34/119, 124, 125; 165/89, 90

[56] References Cited

U.S. PATENT DOCUMENTS

| | | | |
|---|---|---|---|
| 1,919,416 | 7/1933 | Cram | 34/125 |
| 2,934,831 | 5/1960 | Tasker | 34/25 |
| 2,993,282 | 7/1961 | Daane et al. | 34/125 |
| 3,034,225 | 5/1962 | Hieronymus | 34/125 |
| 3,943,638 | 3/1976 | Robson | 34/119 |
| 4,155,177 | 5/1979 | Justus | 34/125 |
| 4,205,457 | 6/1980 | Sjostrand | 34/125 |
| 4,369,586 | 1/1983 | Wedel | 34/119 |
| 4,516,334 | 5/1985 | Wanke | 34/119 |
| 4,538,360 | 9/1985 | Chance et al. | 34/125 |
| 4,606,136 | 8/1986 | Pflug | 34/119 |
| 4,663,864 | 5/1987 | Schiel | 34/124 |
| 4,691,452 | 9/1987 | Ferguson | 34/119 |
| 5,020,243 | 6/1991 | Miller et al. | 34/119 |
| 5,109,612 | 5/1992 | Timm | 34/119 |

FOREIGN PATENT DOCUMENTS 156758 10/1985 European Pat. Off. .

*Primary Examiner*—Denise Gromada
*Attorney, Agent, or Firm*—Dressler, Goldsmith, Shore, Milnamow, Ltd.

[57] ABSTRACT

An elevation part (10) added under the nozzle (11) of a condensate pick-up shoe in a steam cylinder (4), by which part a desired liquid level can be produced in the cylinder.

5 Claims, 5 Drawing Sheets

DEVICE FOR REMOVING LIQUID FROM INSIDE A ROTATING CYLINDER OR ROLL

The invention relates to a device by means of which the operation of spoiler bars installed inside a cylinder can be improved. The device to which the invention is applied is a rotating device for removing condensate or water, i.e. a so-called condensate pick-up shoe. The improvement can be made in any known rotating condensate pick-up shoes by replacing the condensate-removing part pressed against the interior surface of the cylinder (or roll) with a new condensate-removing part constructed according to the method and forming a predetermined layer of condensate.

The device according to the invention is based on combining the functions of a number of prior-known devices. It has always been desired that the cylinders or rolls of a paper-making machine or other similar machine have a good performing capacity. The cylinders used for drying are heated with steam which, when cooling, condenses as water of condensation inside the cylinder. Respectively, when rolls or cylinders are cooled using water, water has been directed into the cylinder via nozzles. From inside the cylinder the water of condensation is removed in a manner known per se by means of either a rotating or a stationary condensate pick-up shoe, or also by means of a device called a siphon. The rotating pick-up shoe is supported fixedly inside the cylinder and rotates at the angular velocity of the cylinder. A stationary siphon is supported outside the cylinder against the frame structures of the machine and does not rotate together with the cylinder. A rotating siphon is widely used for removing condensate from cylinders. It is essential in the construction of a rotating siphon that the tip of the siphon is close to the interior surface of the cylinder (or roll). The condensate is removed from inside the cylinder by means of a pressure difference. Some volume of blow-through steam (or gas) is always needed for the removal of condensate. The higher the rotational velocity of the cylinder, the greater the force, caused by the centrifugal force, resisting the removal of liquid. Nowadays a high production efficiency of paper-making machines is aimed at. In practice this has meant that the rotational velocity of the cylinders has continually been increased. The constructors of the condensate pick-up shoes have construed their product so that the ratio of the rate of condensate removed to the volume of blow-through steam is at its optimum. This is important in terms of energy economy.

When the paper machine cylinder rotates, centrifugal force has a significant detrimental role in determining the drying process. The higher the rotational velocity of the cylinder, the more strongly the condensate is pressed against the interior surface of the cylinder. This force also prevents the effect of forces which produce internal turbulence of the condensate layer. The condensate layer will be laminar. Thereby the transfer of heat through the condensate layer is worsened.

The heat transfer of paper machine cylinders has been improved by known methods (e.g. U.S. Pat. No. 4,195,417). These spoiler bars installed inside the cylinder have functioned effectively and have improved the transfer of heat in the drying cylinders in paper-making machines. The higher the velocity of the dryer (=rotational velocity), the more the transfer of heat has been improved by spoiler bars.

It has also been known that spoiler bars work best if there is a correct and sufficiently thick layer of condensate in the cylinders. Without this condensate layer the spoiler bars will not work uniformly.

The manufacturers of rotating condensate pick-up shoes have in their own constructions aimed at having a maximally thin condensate layer inside the cylinder. This is important per se, since the condensate layer being thin has helped improving the transfer of heat from inside the cylinder outwards. However, the lowering effect of the rotational velocity on the transfer of heat is stronger than the effect obtainable through thinning the condensate layer. Efforts have been made to eliminate this by installing turbulence-increasing spoiler bars also in cylinders equipped with rotating condensate pick-up shoes. This is where the essential advantage of the arrangement according to this invention becomes evident.

In order for the spoiler bars to function uniformly and with a high efficiency, the cylinders must have a sufficiently thick condensate layer. When rotating siphons have been used, a very thin condensate layer has been the aim. In such a case, the correct conditions for efficient operation of spoiler bars are not created. By using the device according to the invention, a correct and uniform condensate layer can be produced in the cylinders (or rolls), without a detrimental quantity of through-blast steam or gas coming from the condensate pick-up shoe of the cylinder.

BRIEF DESCRIPTION OF THE DRAWINGS

The principle of the invention is depicted in the accompanying six figures. FIG. 1 depicts the cylinder or roll to which the device of the method is applied. Part 1 is the condensate pick-up nozzle to which the invention relates. Parts 2 and 3 direct the condensate and the blow-through steam out from inside the cylinder (part 4). Part 5 is the cylinder shaft through which the horizontal pipe of the condensate pick-up shoe is directed. FIG. 2 depicts the device according to the invention. Part 11 is the nozzle for the actual condensate removal, the correct ratio of the blow-through steam to the condensate to be removed being controlled by its shape. This is important in itself. Part 12 is the vertical pipe of the condensate pick-up shoe; this pipe is subjected to the centrifugal force of the rotation of the cylinder. The greater the centrifugal force (=function of the rotational velocity), the higher the differential pressure which is required for removing the condensate. It is important to maintain the correct shape of the aperture of the condensate pick-up shoe in order that the amount of the blow-through steam can be limited in proportion to the amount of the condensate. An excessive amount of blow-through steam is economically detrimental. In general, rotating siphons are constructed at the height of 1/16" of free aperture.

Part 10 in FIG. 2 is an improvement according to the invention for existing equipment. By means of this additional elevation installed or constructed under a rotating condensate pick-up shoe, a correct condensate layer is obtained in the cylinder for the spoiler bars (part 21) shown in FIG. 5 to operate efficiently. The height of part 10 may at its most advantageous be 1.5..2.0 mm, but a thickness as great as 10 mm is possible. FIG. 3 shows a rotating condensate pick-up shoe without this part 10 which increases the thickness of the condensate layer. FIG. 4*a* depicts the tip of a rotating condensate pick-up shoe known per se. From this, also, it can be seen that the conventional rotating condensate pick-up shoe aims at a thin condensate layer and a small amount of blow-through steam. The part 10 according to the invention can also be applied to the nozzle of the condensate pick-up shoe according to FIG. 4*a*. An embodiment of this is shown in FIG. 4*b*.

FIG. 5 depicts an arrangement according to U.S. Pat. No. 4,195,417 for improving the transfer of heat in a drying cylinder. These spoiler bars (part 21) must be placed in the cylinder at correct intervals in relation to each other in order that efficient heat transfer be obtained through the cylinder wall (part 4). On the other hand, the heat transfer is not improved if there is not a sufficient amount of condensate in the cylinder. FIG. 6 depicts the device according to the invention as a whole. The combination of a condensate-removing nozzle and spoiler bars improves the heat transfer in existing cylinders and rolls equipped with rotating siphons. The improved heat transfer provides a possibility to increase the production capacity of existing drying cylinders. Thereby the profitability of the production line is also increased.

Figure 1:
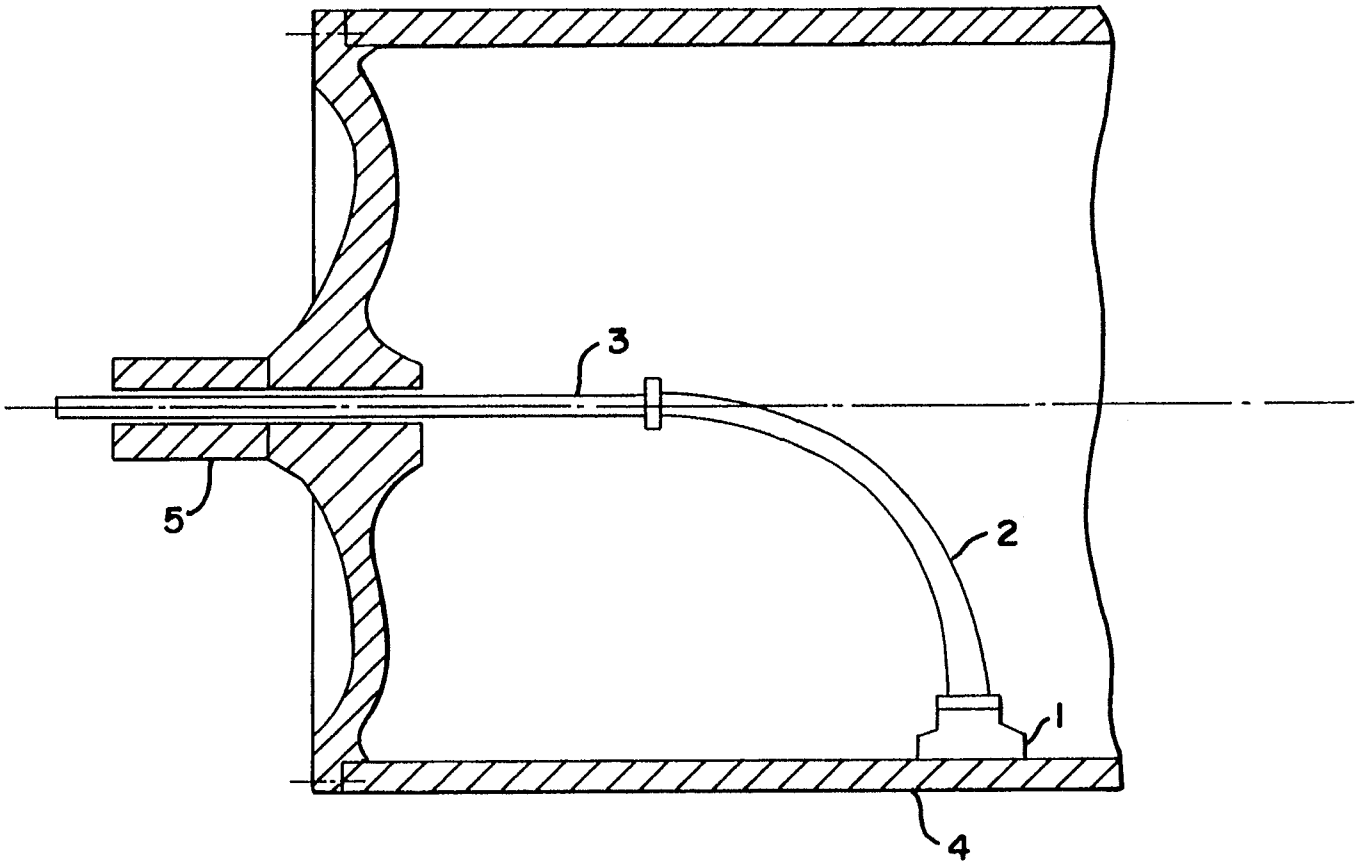
FIG. 1 PRIOR ART
FIG. 1 is a partial cross-sectional view of a prior art device for removing liquid from inside a cylinder.
Figure 2:
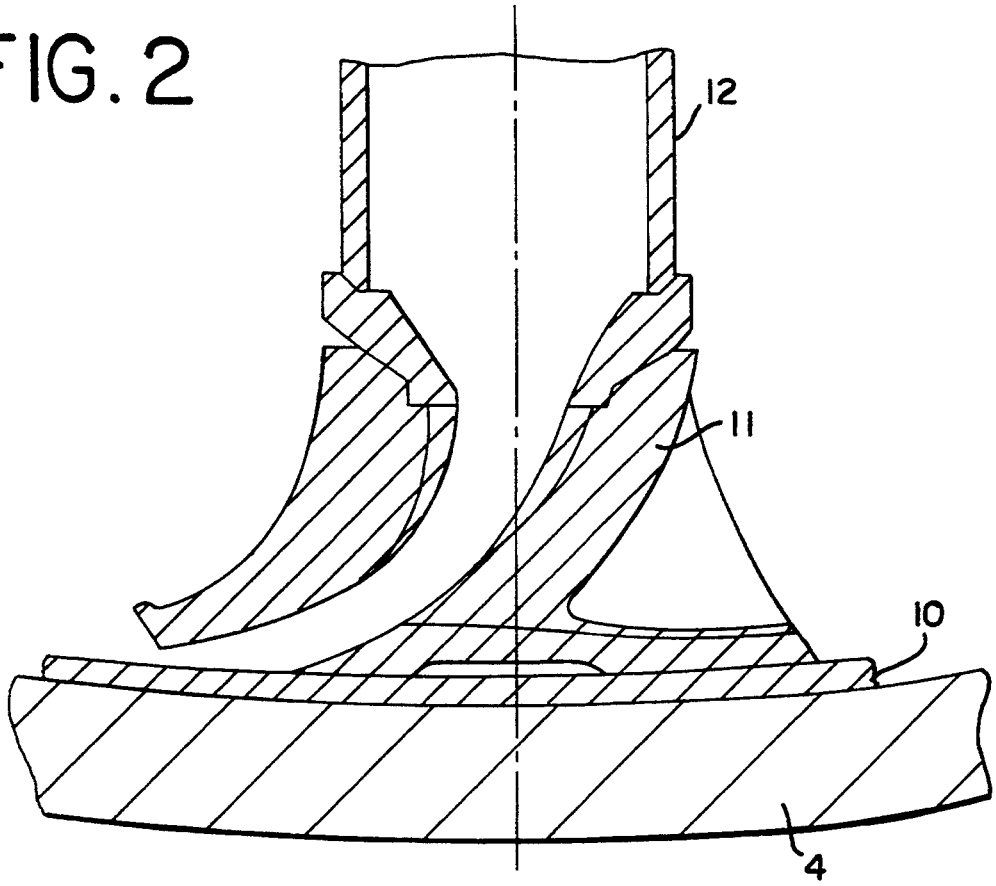
FIG. 2 is a cross-sectional view illustrating applicant's invention.
Figure 3:
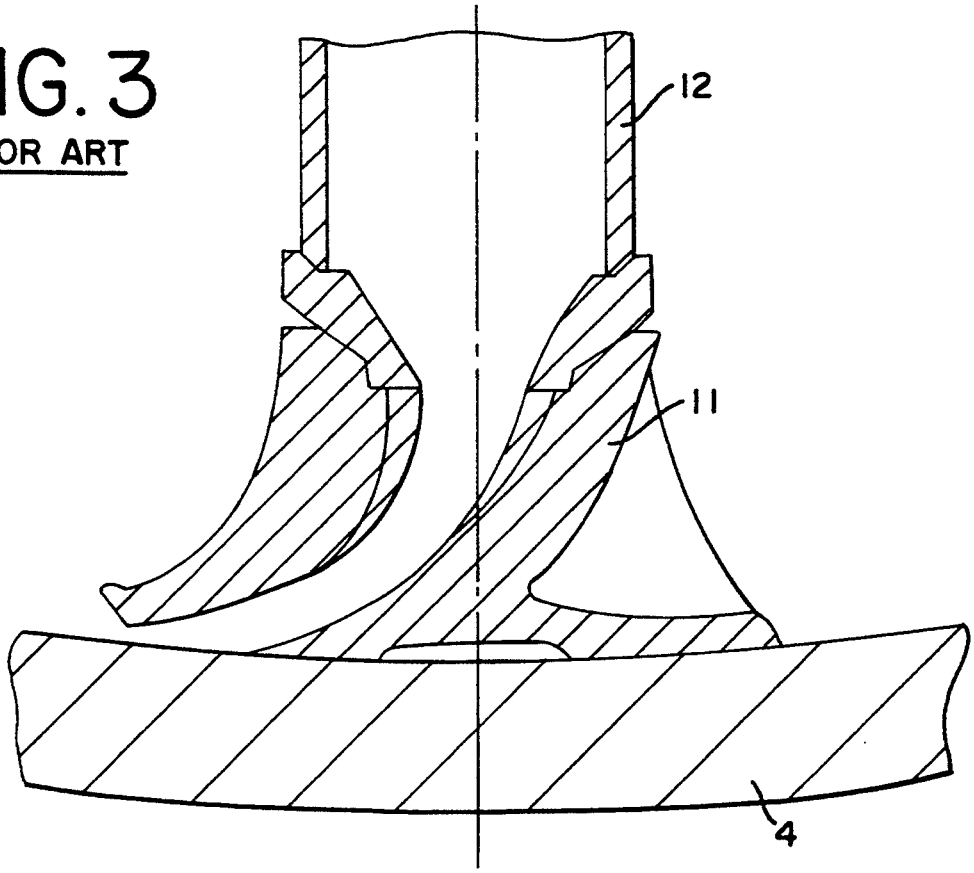
FIG. 3 PRIOR ART
FIG. 3 is a cross-sectional view similar to FIG. 2, but not embodying applicant's invention.
Figure 4A:
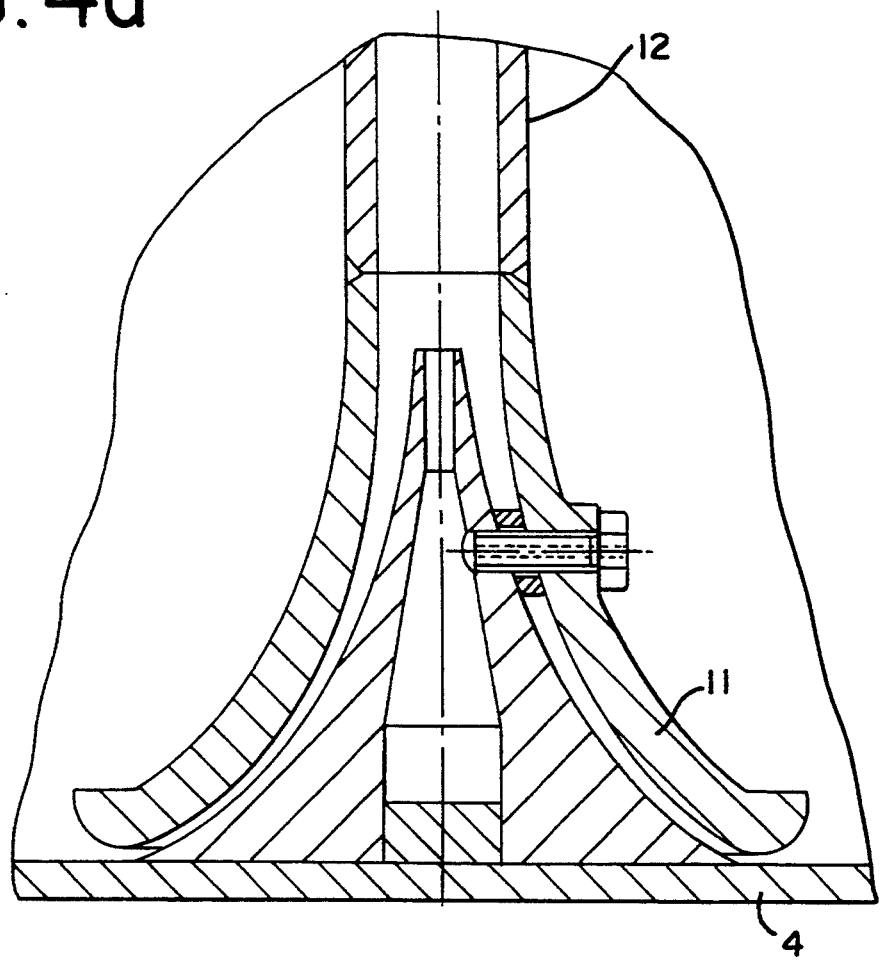
FIG. 4*a* is a cross-sectional view of another prior art embodiment.
Figure 4B:
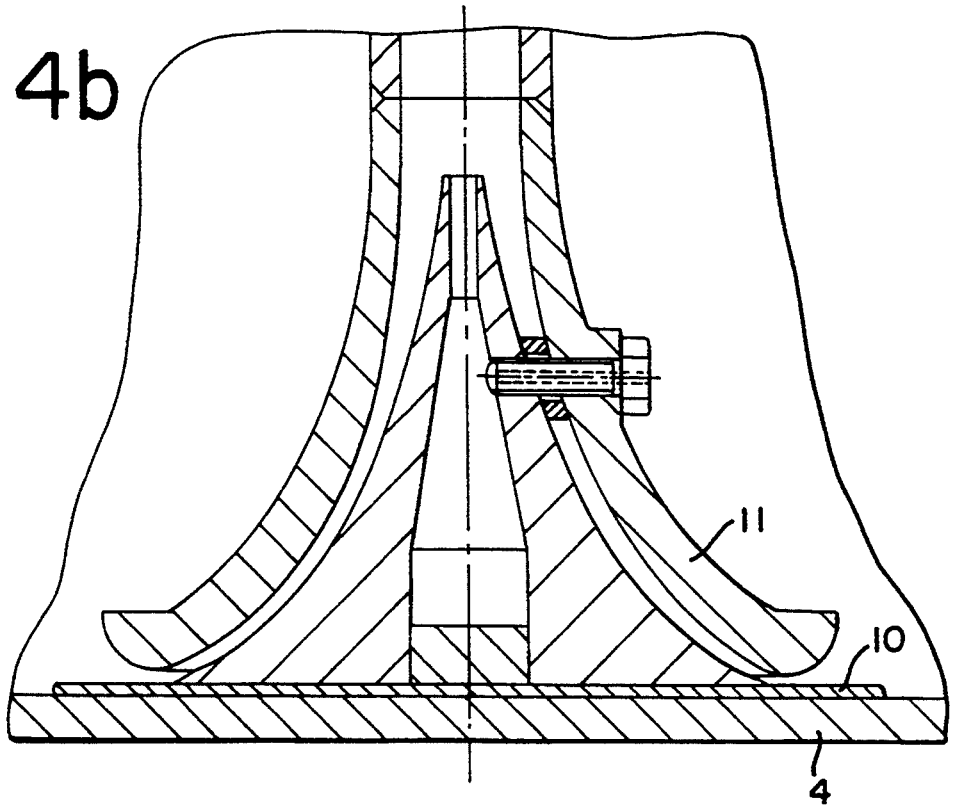
FIG. 4*b* is a cross-sectional view similar to FIG. 4*a* embodying applicant's invention.
Figure 5:
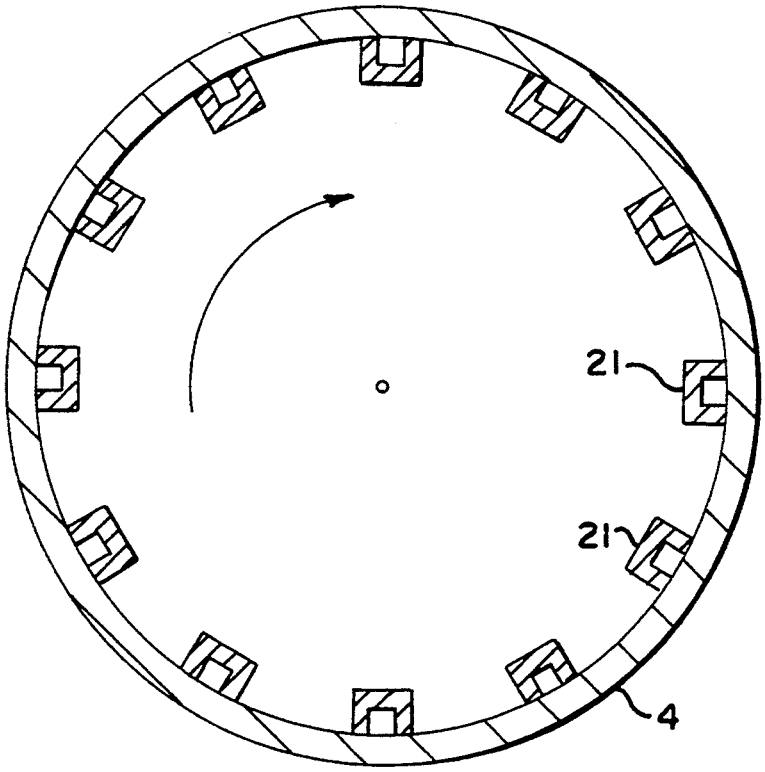
FIG. 5 is a cross-sectional view illustrating the orientation of spoiler bars within the cylinder.
Figure 6:
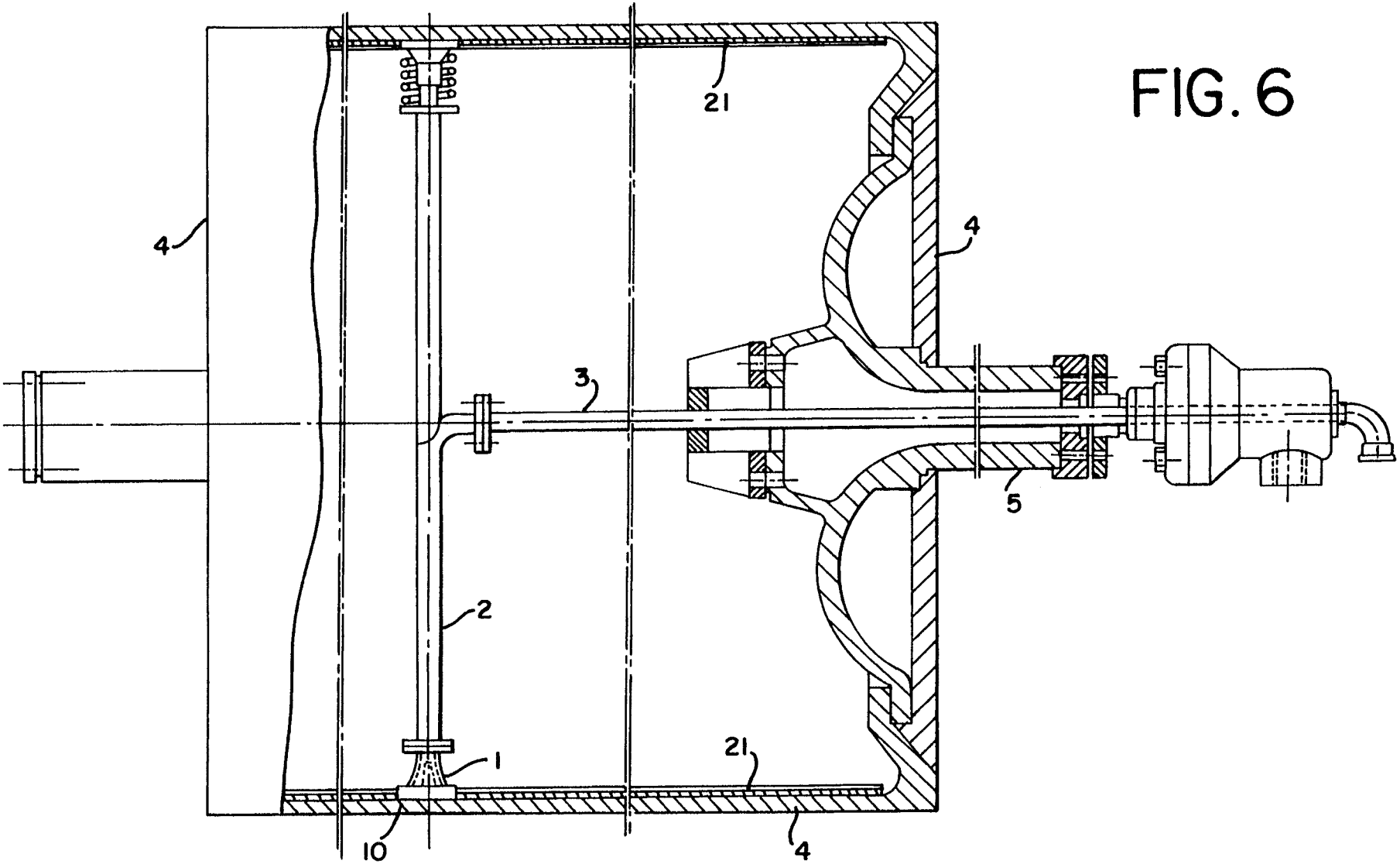
FIG. 6 is a more detailed view of a cylinder construction illustrating applicant's invention.

I claim:

1. A device for removing liquid from inside a rotating cylinder comprising a rotating siphon including a liquid-removing nozzle disposed within said cylinder over an annular relatively narrow area of an inner surface of said cylinder, which nozzle is located in spaced relation from said inner surface, spoiler bars extending longitudinally over a major surface area of the inner surface of said cylinder adjacent said narrow area for effecting turbulence of condensate to improve the heat transfer through said major area during the rotation of said cylinder and said siphon, an elevation part secured to the inner surface of the cylinder and covering said annular relatively narrow area and being slightly spaced from said nozzle whereby a relatively thick layer of condensate will be maintained in said cylinder adjacent said elevation part whereby the spoiler bars will function uniformly and with a high degree of efficiency and the siphon will be close to an inner surface of the cylinder to prevent a detrimental quantity of steam being removed with the condensate.

2. A device as set forth in claim 1 in which the elevation part is wider than the width of the nozzle.

3. A device as set forth in claim 1 in which the spoiler bars are located on opposite sides of said nozzle.

4. A device as set forth in claim 1 in which the thickness of the elevation part is in the range of 1.5–10 mm.

5. A device as set forth in claim 1 in which the thickness of the elevation part is in the range of 1.5–2 mm.

* * * * *